US009472337B2

(12) United States Patent
Shaw et al.

(10) Patent No.: US 9,472,337 B2
(45) Date of Patent: Oct. 18, 2016

(54) ELECTROSTATIC SHIELD FOR A TRANSFORMER

(75) Inventors: Steven A. Shaw, Greenville, NC (US); Jashbhai S. Patel, Rocky Mount, NC (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/111,106

(22) PCT Filed: Apr. 12, 2012

(86) PCT No.: PCT/US2012/033286

§ 371 (c)(1),
(2), (4) Date: Oct. 10, 2013

(87) PCT Pub. No.: WO2012/142261

PCT Pub. Date: Oct. 18, 2012

(65) Prior Publication Data

US 2014/0232509 A1 Aug. 21, 2014

Related U.S. Application Data

(60) Provisional application No. 61/475,552, filed on Apr. 14, 2011.

(51) Int. Cl.
*H01F 27/32* (2006.01)
*H01F 27/36* (2006.01)
(Continued)

(52) U.S. Cl.
CPC ..... *H01F 27/362* (2013.01); *H01F 38/20* (2013.01); *H01F 38/28* (2013.01); *H01F 41/00* (2013.01); *H01F 38/34* (2013.01); *Y10T 29/49073* (2015.01)

(58) Field of Classification Search
CPC ..... H01F 27/362; H01F 38/20; H01F 38/28; H01F 38/24; H02H 7/042
USPC .... 336/84 R, 84 C, 173, 174, 175, 177, 182; 324/127, 76.11
See application file for complete search history.

(56) References Cited

U.S. PATENT DOCUMENTS 2,924,796 A * 2/1960 Stauber ..... H01F 38/30 336/174
3,629,693 A * 12/1971 Anderson ..... H01F 38/30 323/358

(Continued)

FOREIGN PATENT DOCUMENTS

JP 8273951 A 10/1966
JP 6109114 A 1/1986

(Continued)

OTHER PUBLICATIONS

N. Warneck, International Searching Authority (EPO), International Search Report and Written Opinion of the International Searching Authority for International Application No. PCT/US2012/033286, European Patent Office, mailed Aug. 7, 2012.

*Primary Examiner* — Alexander Talpalatski
*Assistant Examiner* — Joselito Baisa
(74) *Attorney, Agent, or Firm* — Taft Stettinius & Hollister LLP

(57) ABSTRACT

An electrostatic shield for controlling the electrostatic field between a high voltage conductor and a low voltage conductor in an instrument transformer is provided. The instrument transformer has a current transformer and a voltage transformer. The current transformer has a split core which includes a first core segment and a second core segment. When the first core segment adjoins the second core segment, a current transformer is formed, having a core formed from the first and second core segments. The high voltage conductor runs between the first and second core segments of the current transformer. The first core segment is encapsulated in a polymer resin and when encapsulated, forms a first encasement. The second core segment has a low voltage winding mounted thereon. The electrostatic shield is disposed between the low voltage winding and the high voltage conductor. A second encasement is formed by encapsulating the electrostatic shield, low voltage winding and second core segment in a polymer resin.

19 Claims, 3 Drawing Sheets

(51) Int. Cl.

| | |
|---|---|
| ***G01V 3/10*** | (2006.01) |
| ***H01F 38/20*** | (2006.01) |
| ***H01F 17/06*** | (2006.01) |
| ***H01F 38/28*** | (2006.01) |
| ***H01F 41/00*** | (2006.01) |
| *H01F 38/34* | (2006.01) |

(56) References Cited

U.S. PATENT DOCUMENTS 3,683,302 A * 8/1972 Butler ..... H01H 83/144 336/174
3,701,003 A * 10/1972 Anderson ..... H01F 38/30 323/358
3,842,186 A * 10/1974 Hall ..... 174/396
3,921,113 A * 11/1975 Schiemann ..... H01F 38/30 336/174
4,384,289 A * 5/1983 Stillwell ..... G01K 1/024 324/126
4,386,280 A * 5/1983 Ricaud ..... G01R 15/185 307/145
4,717,872 A * 1/1988 Wagner ..... G01R 15/202 324/117 H
5,252,913 A * 10/1993 Falkowski et al. ..... 324/127
5,514,964 A * 5/1996 Benesh ..... G01R 31/025 324/509
5,990,775 A * 11/1999 Inui ..... H01F 27/324 174/356
7,190,561 B2 * 3/2007 Pellon ..... H02H 1/0015 361/5
7,550,960 B2 * 6/2009 Barbour ..... G01R 15/06 324/117 R
8,536,857 B2 * 9/2013 Nero, Jr. ..... 324/119

FOREIGN PATENT DOCUMENTS

JP 2035704 A 2/1990
JP 2020232389 A 10/2010

* cited by examiner

ELECTROSTATIC SHIELD FOR A TRANSFORMER

FIELD OF INVENTION

The present application is directed to an electrostatic shield for controlling electrostatic field stress in a split core instrument transformer.

BACKGROUND

This invention relates to instrument transformers and more particularly to an electrostatic shield for controlling the electrostatic field in a split core instrument transformer.

Instrument transformers include current transformers and voltage transformers and are used to measure the properties of electricity flowing through conductors. Current and voltage transformers are used in measurement and protective applications, together with equipment, such as meters and relays. Such transformers "step down" the current and/or voltage of a system to a standardized value that can be handled by associated equipment. For example, a current transformer may step down current in a range of 10 to 2,500 amps to a current in a range of 1 to 5 amps, while a voltage transformer may step down voltage in a range of 12,000 to 40,000 volts to a voltage in a range of 100 to 120 volts. Current and voltage transformers may be used to measure current and voltage, respectively, in an elongated high voltage conductor, such as an overhead power line.

A conventional current transformer for measuring current in a high voltage conductor typically has a unitary body with an opening through which the conductor extends. Such a conventional current transformer has a unitary core, which is circular or toroidal in shape and has a central opening that coincides, at least partially, with the opening in the body. With such a construction, the current transformer is mounted to the conductor by cutting and then splicing the conductor. As can be appreciated such cutting and splicing is undesirable. Accordingly, current transformers having two-piece or split cores have been proposed. Examples of current transformers having split cores are shown in U.S. Pat. No. 4,048,605 to McCollum, U.S. Pat. No. 4,709,339 to Fernandes and US20060279910 to Gunn et al.

The control of electrostatic field stress is an issue in a split core current transformer having a high voltage conductor disposed between the split core segments, one of which core segments has a low voltage conductor wound thereon. Uncontrolled electrostatic field stress between the high and low voltage conductors can cause partial discharges that will eventually erode the insulating material between the high and low voltage conductors and the split core segments. While electrostatic shields are available to reduce the electrostatic field stress experienced between high and low voltage conductors, there is room for improvement in electrostatic shields.

Accordingly, the present invention is directed to an electrostatic shield for controlling the electrostatic field in a current transformer.

SUMMARY

An instrument transformer for measuring the properties of electricity flowing in an elongated conductor comprises a first core segment and a second core segment, each having at least one end surface. A first encasement formed of a polymer resin encapsulates the first core segment except for the at least one end surface. The second core segment has a low voltage winding wound thereon. An electrostatic shield is provided for connection to the elongated conductor. A second encasement formed of a polymer resin encapsulates the electrostatic shield, the low voltage winding, and the second core segment except for the at least one end surface. The electrostatic shield is embedded in the polymer resin of the second encasement and disposed slightly beneath an outer planar surface of the second encasement.

A method of making an instrument transformer comprises providing a first core segment and encapsulating the first core segment in a polymer resin to form a first encasement. The method of making an instrument transformer further comprises providing a second core segment, mounting a low voltage winding to the second core segment, providing an electrostatic shield between a high voltage conductor and the low voltage winding, and positioning the electrostatic shield above and out of contact with the low voltage winding. A second encasement is formed by encapsulating the second core segment, low voltage winding and electrostatic shield in a polymer resin.

BRIEF DESCRIPTION OF THE DRAWINGS

In the accompanying drawings, structural embodiments are illustrated that, together with the detailed description provided below, describe exemplary embodiments of an electrostatic shield for a transformer. One of ordinary skill in the art will appreciate that a component may be designed as multiple components or that multiple components may be designed as a single component.

Further, in the accompanying drawings and description that follow, like parts are indicated throughout the drawings and written description with the same reference numerals, respectively. The figures are not drawn to scale and the proportions of certain parts have been exaggerated for convenience of illustration.

DETAILED DESCRIPTION

Figure 2:
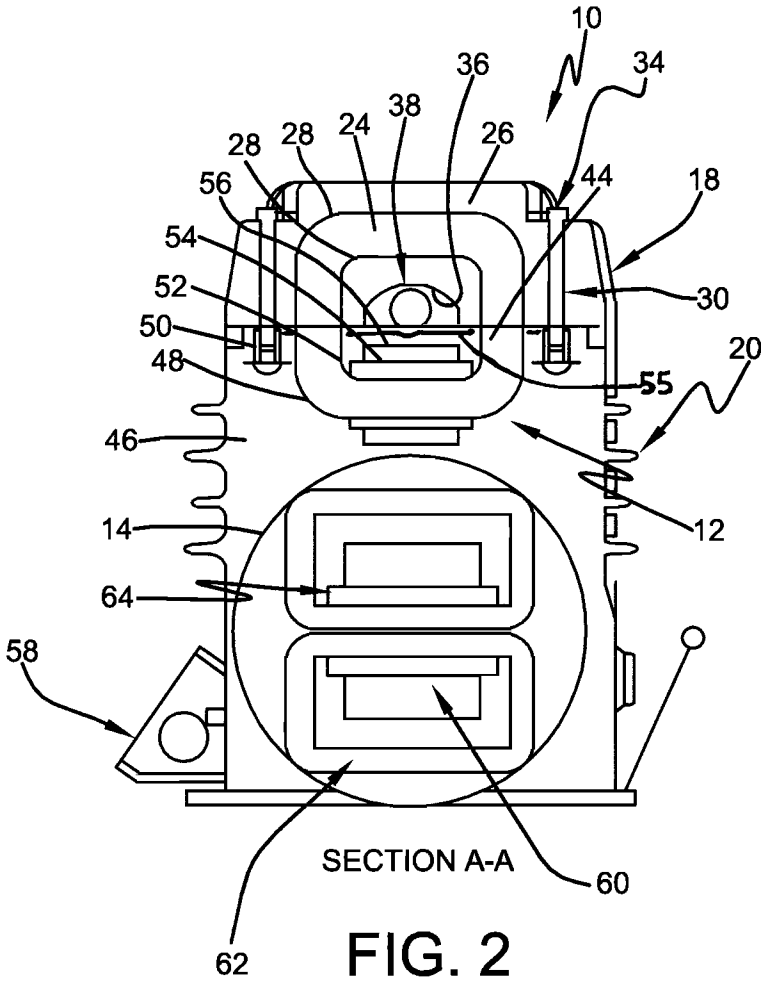
FIG. 2 is a schematic sectional view of the instrument transformer taken along line A-A in FIG. 1.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

As used herein, the abbreviation "CT" shall mean "current transformer".

Figure 1:
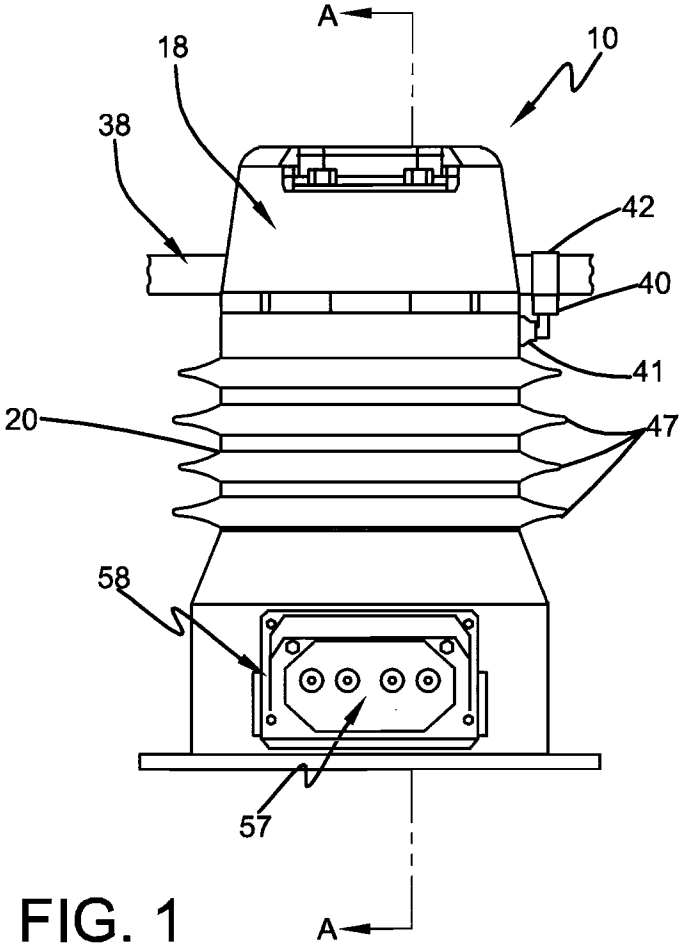
FIG. 1 is a front view of an instrument transformer embodied in accordance with the present invention.

Referring now to FIGS. 1 and 2, there are shown views of an instrument transformer 10 embodied in accordance with the present invention. The instrument transformer 10 includes a current transformer 12 and a voltage transformer 14. One of ordinary skill in the art will recognize that the instrument transformer 10 may be embodied as a current transformer 12 alone. The current transformer 12 and the voltage transformer 14 are arranged in a cover section 18 and a base section 20 that are releasably secured together. The voltage transformer 14 is fully disposed in the base section 20, while the current transformer 12 is partially disposed in the cover section 18 and partially disposed in the base section 20. The current transformer 12 is operable to measure the current in a high voltage conductor (such as high voltage conductor 38), while the voltage transformer 14 is operable to measure the voltage in the high voltage conductor 38. The voltage transformer 14 also supplies power to the electronics for the instrument transformer 10.

The cover section 18 includes a top or first core segment 24 encapsulated in a top or first encasement 26 formed from one or more polymer resins in a cover casting process. The first core segment 24 is generally U-shaped and is comprised of ferromagnetic metal, such as grain-oriented silicon steel or amorphous steel. The first core segment 24 may be formed from layers of metal strips or a stack of metal plates. An electrostatic shield 28 is disposed over and covers the first core segment 24, except for the ends thereof. The electrostatic shield 28 may be formed from one or more layers of semi-conductive tape that are wound over a layer of closed cell foam padding that encompasses the first core segment 24. The first encasement 26 fully covers the first core segment 24 except for the ends thereof, which are exposed at a bottom surface of the first encasement 26. At least a portion of the bottom surface of the first encasement 26 is substantially flat (planar) so as to permit the bottom surface to be disposed flush with a top surface of a second encasement 46 of the base section 20.

An electrostatic shield 55 embodied in accordance with the present invention is depicted in FIGS. 3*a*-3*d* and is disposed between the high voltage conductor 38 and a low voltage winding 54. The electrostatic shield 55 is embedded within a polymer resin of the second encasement 46 and located slightly beneath a substantially planar surface of the second encasement 46. For example, the electrostatic shield 55 may be located at a depth of about 3.175 mm to about 19.05 mm from the substantially planar surface of the second encasement 46. Additionally, the electrostatic shield 55 may be located at a distance of about 12.7 mm to about 25.4 mm from the low voltage winding 54 or ground components.

The electrostatic 55 shield is generally oval in shape and extends laterally through the second encasement, shielding the low voltage winding 54 from the high voltage conductor 38. The electrostatic shield 55 may be embodied as a solid, perforated or mesh sheet formed from a semi-conductive or conductive material such as aluminum, brass, copper, cellulose impregnated with a conductive or semi-conductive material, or any material having similar properties. In one embodiment, the perforated or mesh sheet allows a polymer resin to permeate through the openings in the electrostatic shield 55 during a casting process, the casting process to be described in further detail below.

Figure 3A:
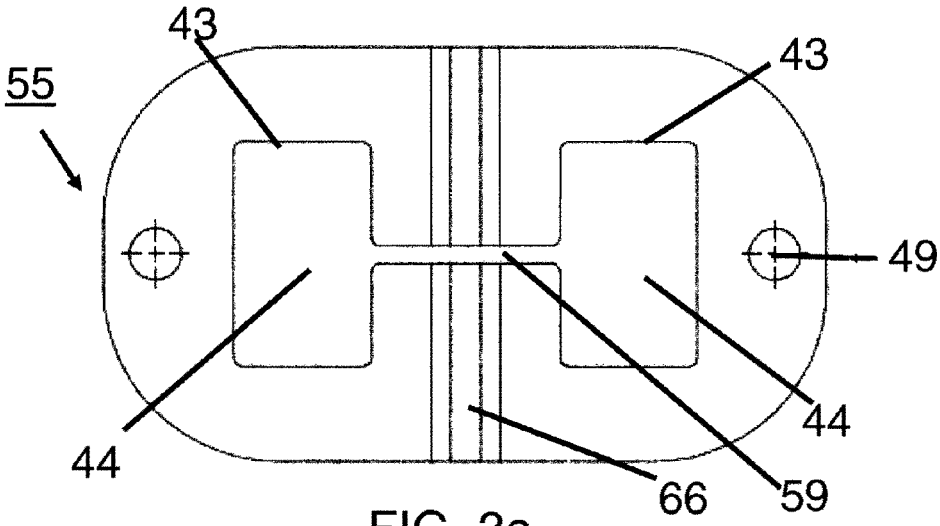
FIG. 3*a* is a top view of an electrostatic shield embodied in accordance with the present invention.
Figure 3B:
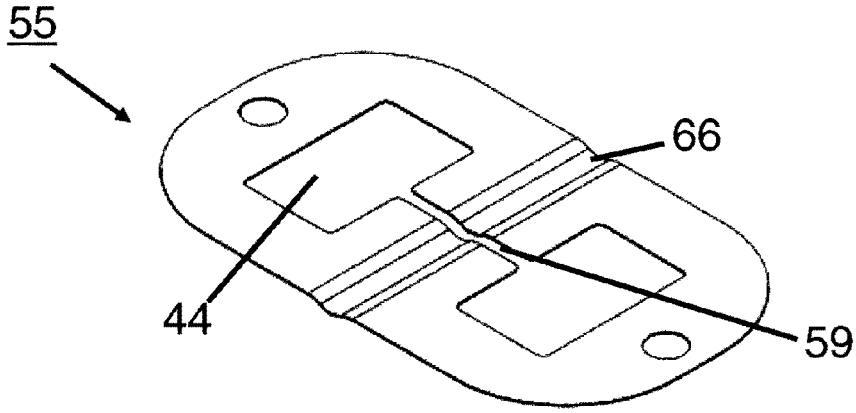
FIG. 3*b* is an isometric view of the electrostatic shield.
Figure 3C:
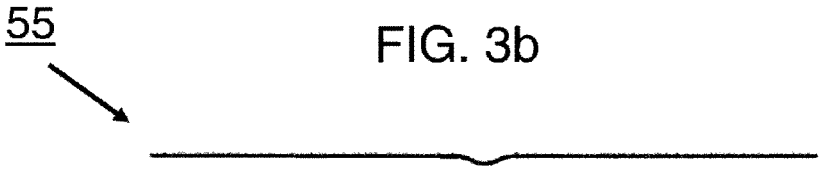
FIG. 3*c* is a front view of the electrostatic shield.
Figure 3D:
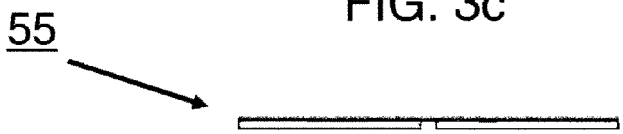
FIG. 3*d* is a right side view of the electrostatic shield.
Figure 4:
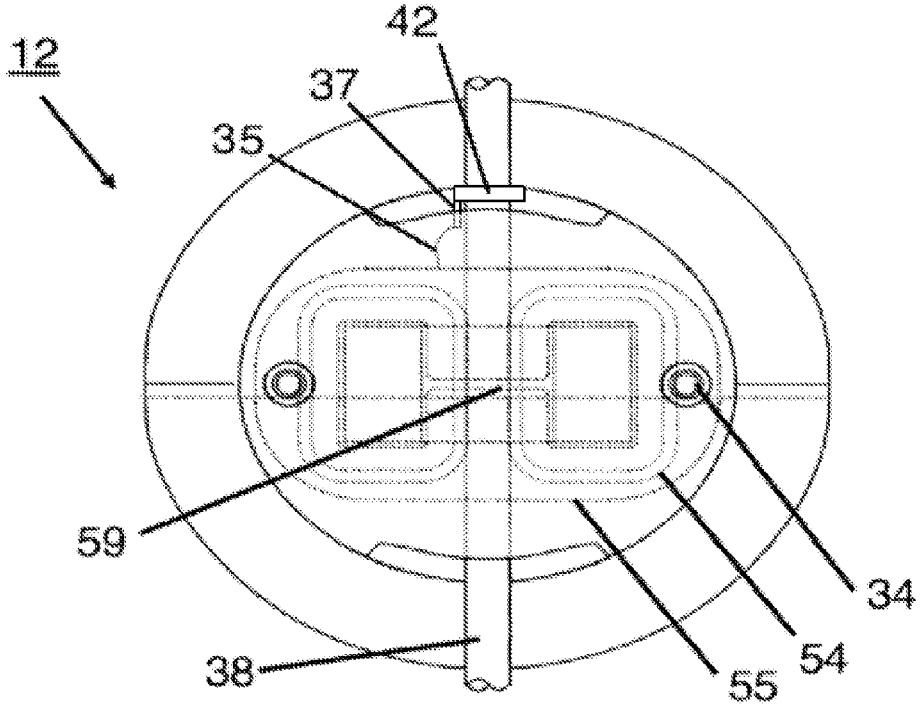
FIG. 4 is a sectional top view of a current transformer embodied in accordance with the present invention.

Referring now to FIGS. 3*a*, 3*b*, and 4, the electrostatic shield 55 has a gap 59 that prevents a continuous conductive path around the first and second core segments 24, 44. The electrostatic shield 55 has a generally arcuate recess 66 that runs from a first side of the electrostatic shield 55 to an opposing, second side of the electrostatic shield 55. The high voltage conductor 38 is disposed slightly above the recess 66. The high voltage conductor 38 does not touch the electrostatic shield 55. The electrostatic shield has one or more cut-outs 43 through which the second core segment 44 slightly extends. The electrostatic shield has one or more openings 49 for threaded bolts 34.

The electrostatic shield 55 is electrically connected to the high voltage conductor 38 through lead wires 35 that run from the electrostatic shield 55 to metallic inserts 37 The metallic inserts 37 are embedded in the polymer resin and are further attached to clamps 42 in direct connection with the high voltage conductor 38. The electrostatic shield 55 is at about the same potential as the high voltage conductor 38.

Referring now to FIGS. 1 and 2, a plurality of bore inserts 30 extend through the first encasement 26 from the top to the bottom thereof. The bore inserts 30 are arranged around the first core segment 24 and are adapted to receive threaded bolts 34 for securing the cover section 18 to the base section 20, as will be further described below. A main passage 36 extends laterally through the first encasement 26 and is adapted to accommodate a high voltage conductor 38, such as an overhead power line. The high voltage conductor 38 may carry electricity at a voltage from about 1 kV to about 52 kV. When the instrument transformer is installed and the high voltage conductor 38 extends through the main passage 36, a connector 40 electrically connects the un-insulated high voltage conductor 38 to the first core segment 24 and the second core segment so that the first core segment 24, second core segment 44, connector 40, and threaded bolts 34, are at about the same potential as the high voltage conductor 38. The connector 40 may be connected to a terminal 41 mounted on the outside of the first encasement 26 and the terminal 41 may then be electrically connected to the first core segment 24 by an internal conductor. The connector 40 may be connected to the high voltage conductor 38 by a clamp 42.

The base section 20 includes a bottom or second core segment 44 encapsulated in a bottom or second encasement 46 formed from one or more polymer resins in a base casting process. The second encasement 46 has a plurality of circumferentially-extending sheds 47. The second core segment 44 is also generally U-shaped and has the same construction as the first core segment 24. In one embodiment, the first and second core segments 24, 44 are produced by constructing a single core and then cutting the core in half. The second encasement 46 fully covers the second core segment 44 except for the ends thereof, which are exposed at a top surface of the second encasement 46. At least a portion of the top surface of the second encasement 46 is substantially flat (planar) so as to permit the top surface to be disposed flush with the bottom surface of the first encasement 26 of the cover section 12. When the cover section 12 is secured to the base section 20, the exposed ends of the first and second core sections 24, 44 abut each other, thereby forming (or re-forming) a core of the current transformer 12.

The second core segment 44 is supported on a cradle 48 having a C-shaped middle section and opposing peripheral flanges. The cradle 48 is formed from an epoxy resin or any material having similar properties. Mounts 50 are secured to the flanges and have threaded interiors for threadably receiving ends of the bolts 34 extending through the bore inserts 30. A layer of closed cell foam padding, an insulation tube 52 and a low voltage winding 54 are disposed over the second core segment 44 and the middle section of the cradle 48, with the closed cell foam padding being disposed over the second core segment 44 and the insulation tube 52 being disposed between the layer of closed cell foam padding and the low voltage winding 54. The insulation tube 52 is composed of a dielectric material and electrically insulates the low voltage winding 54 from the second core segment 44. The insulation tube 52 may be comprised of a dielectric resin (such as an epoxy resin), layers of an insulating tape or a phenolic kraft paper tube (i.e., a kraft paper tube impregnated with a phenolic resin). The low voltage winding 54 is wound around the insulation tube 52 and is comprised of a plurality of turns of a conductor composed of a metal, such as copper. An electrostatic shield 56 is disposed over and covers the low voltage winding 54. The electrostatic shield 56 may be formed from one or more layers of semi-conductive tape that are wound over the low voltage winding 54. The cradle 48, the insulation tube 52 and the low voltage winding 54 are all encapsulated in the second encasement 46.

The low voltage winding 54 may have a single CT ratio or multiple CT ratios. In this regard, it should be noted that a CT ratio is the ratio of the rated primary current (in the high voltage conductor 38) to the rated secondary current (in the low voltage winding 54). If the low voltage winding 54 has a multi-ratio construction, different combinations of taps may provide a range of CT ratios, such as from 50:5 to 600:5 or from 500:5 to 4000:5. The taps are connected at different points along the travel of the conductor of the low voltage winding 54. For example, if there are five taps, two of the taps may be connected at opposing ends of the low voltage winding 54 and the other three taps may be connected to the low voltage winding 54 in between the two end taps in a spaced apart manner. Thus, the number of turns of the low voltage winding 54 between different pairs of taps is different, thereby creating different CT ratios. The taps on the low voltage winding 54 are connected by conductors to terminals 57 enclosed in a junction box 58 secured to the base section 20.

The voltage transformer 14 includes a winding structure 60 mounted to a core 62 comprised of ferromagnetic metal, such as grain-oriented silicon steel or amorphous steel. As shown, the core 62 may be comprised of two, abutting rings, each of which is formed from layers of metal strips or a stack of metal plates. The winding structure 60 is mounted to abutting legs of the rings. An insulation tube 64 is mounted to the core 62, between the core 62 and the winding structure 60. The insulation tube 64 may be comprised of a dielectric resin (such as an epoxy resin), layers of an insulating tape or a phenolic kraft paper tube.

The winding structure 60 comprises a low voltage winding concentrically disposed inside a high voltage winding. The low voltage winding and the high voltage winding are each comprised of a plurality of turns of a conductor composed of a metal, such as copper. Of course, the number of turns in the two windings is different. As with the current transformer 12, the core 62 and the winding structure 60 of the voltage transformer 14 are each covered with an electrostatic shield, which may have the same construction/composition as the electrostatic shields 28, 56. The high voltage winding of the winding structure 60 is electrically connected to the high voltage conductor 38. The connection may be through the terminal 41 and the first core segment 24. The voltage transformer 14 is operable to step down the voltage supplied to the high voltage winding (e.g., about 1-35 kV) to a lower voltage at the output of the low voltage winding. This lower voltage may be about 110-120 volts, or even lower, down to a voltage of about 10 volts. The output of the low voltage winding is connected to the terminals 57 in the junction box 58. The terminals 57 include terminals for the current measurement output(s) from the current transformer 12 and terminals for the voltage measurement output from the low voltage winding of the voltage transformer 14. The lower voltage power from the voltage transformer 14 is also used to power the electronics in a control box 100 mounted separately from the instrument transformer 10.

The cover section 18 is secured to the base section 20 by inserting the bolts 34 through the bore inserts 30 of the cover section 18 and threadably securing the ends of the bolts 34 in the mounts 50 of the base section 20. The bore inserts 30 in the cover section 18 and the mounts of the base section 20 are positioned so as to properly align the first core segment 24 with the second core segment 44 to form a contiguous core for the current transformer 12 when the cover section 18 and the base section 20 are secured together with the bolts 34. The first encasement 26 and the second encasement 46 may also be formed with corresponding structural features (such as ridges and grooves and holes and posts) that help properly align the cover section 18 and the base section 20.

The cover section 18 may be removed from the base section 20 to permit the instrument transformer 10 to be installed to or uninstalled from the high voltage conductor 38, i.e., to pass the high voltage conductor 38 through the current transformer 12 or remove the high voltage conductor 38 from the current transformer 12. The cover section 18 is removed simply by unthreading the bolts 34 from the mounts 50 and separating the cover section 18 from the base section 20.

The first and second encasements 26, 46 are formed separately in the cover casting process and the base casting process, respectively. Each of the first and second encasements 26, 46 may be formed from a single insulating resin, which is an epoxy resin. In one embodiment, the resin is a cycloaliphatic epoxy resin, still more particularly a hydrophobic cycloaliphatic epoxy resin composition. Such an epoxy resin composition may comprise a cycloaliphatic epoxy resin, a curing agent, an accelerator and filler, such as silanised quartz powder, fused silica powder, or silanised fused silica powder. In one embodiment, the epoxy resin composition comprises from about 50-70% filler. The curing agent may be an anhydride, such as a linear aliphatic polymeric anhydride, or a cyclic carboxylic anhydride. The accelerator may be an amine, an acidic catalyst (such as stannous octoate), an imidazole, or a quaternary ammonium hydroxide or halide.

The cover casting process and the base casting process may each be an automatic pressure gelation (APG) process. In such an APG process, the resin composition (in liquid form) is degassed and preheated to a temperature above 40° C., while under vacuum. The internal components of the section being cast (such as the first core segment 24 and the bore inserts 30 in the cover section 18) are placed in a cavity of a mold heated to an elevated curing temperature of the resin. The degassed and preheated resin composition is then introduced under slight pressure into the cavity containing the internal components. Inside the cavity, the resin composition quickly starts to gel. The resin composition in the cavity, however, remains in contact with pressurized resin being introduced from outside the cavity. In this manner, the shrinkage of the gelled resin composition in the cavity is compensated for by subsequent further addition of degassed and preheated resin composition entering the cavity under pressure. After the resin composition cures to a solid, the encasement with the internal components molded therein is removed from the mold cavity. The encasement is then allowed to fully cure.

It should be appreciated that in lieu of being formed pursuant to an APG process, the first and second encasements 26, 46 may be formed using an open casting process or a vacuum casting process. In an open casting process, the resin composition is simply poured into an open mold containing the internal components and then heated to the elevated curing temperature of the resin. In vacuum casting, the internal components are disposed in a mold enclosed in a vacuum chamber or casing. The resin composition is mixed under vacuum and introduced into the mold in the vacuum chamber, which is also under vacuum. The mold is heated to the elevated curing temperature of the resin. After the resin composition is dispensed into the mold, the pressure in the vacuum chamber is raised to atmospheric pressure for curing the proto-encasement in the mold. Post curing can be performed after demolding the proto-encasement.

In another embodiment of the present invention, each of the first and second encasements 26, 46 has two layers formed from two different insulating resins, respectively, and is constructed in accordance with PCT Application No. WO2008127575, which is hereby incorporated by reference. In this embodiment, the encasement comprises an inner layer or shell and an outer layer or shell. The outer shell is disposed over the inner shell and is coextensive therewith. The inner shell is more flexible (softer) than the outer shell, with the inner shell being comprised of a flexible first resin composition, while the outer shell being comprised of a rigid second resin composition. The first resin composition (when fully cured) is flexible, having a tensile elongation at break (as measured by ASTM D638) of greater than 5%, more particularly, greater than 10%, still more particularly, greater than 20%, even still more particularly, in a range from about 20% to about 100%. The second resin composition (when fully cured) is rigid, having a tensile elongation at break (as measured by ASTM D638) of less than 5%, more particularly, in a range from about 1% to about 5%. The first resin composition of the inner shell may be a flexible epoxy composition, a flexible aromatic polyurethane composition, butyl rubber, or a thermoplastic rubber. The second resin composition of the outer shell is a cycloaliphatic epoxy composition, such as that described above. The encasement is formed over the internal components using first and second casting processes. In the first casting process, the inner shell is formed from the first resin composition in a first mold. In the second casting process, the intermediate product comprising the internal components inside the inner shell is placed in a second mold and then the second resin composition is introduced into the second mold. After the second resin composition (the outer shell) cures for a period of time to form a solid, the encasement with the internal components disposed therein is removed from the second mold. The outer shell is then allowed to fully cure.

Figure 5:
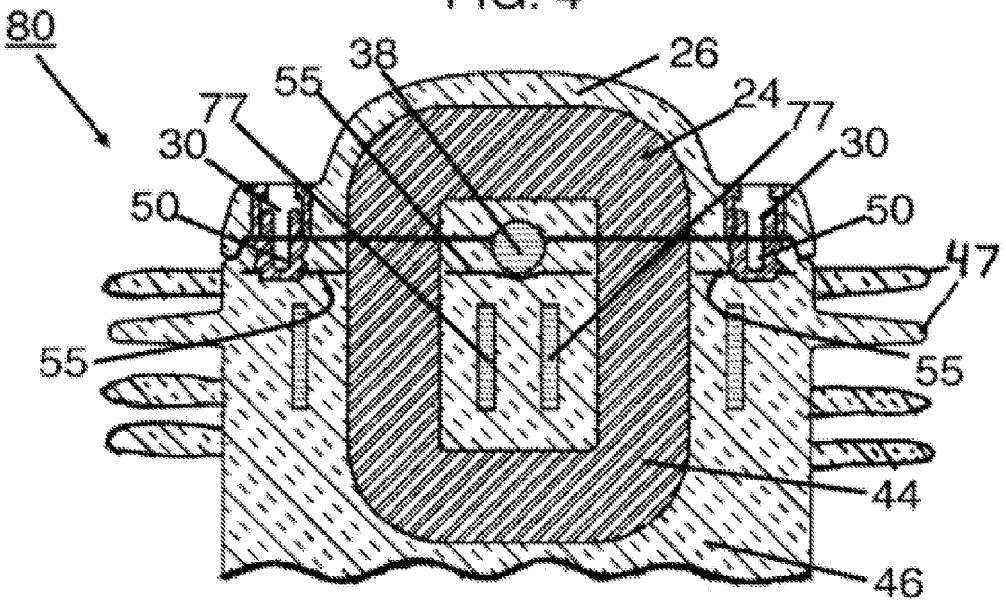
FIG. 5 is a sectional side view of the current transformer having an alternative low voltage winding configuration.

Referring now to FIG. 5, a current transformer 80 is depicted and has the same construction as the instrument transformer 10, except as described below. The voltage transformer 14 included in the instrument transformer 10 is not part of the current transformer 80. Additionally, the current transformer 80 has two low voltage windings 77 that are arranged in a different configuration than the single low voltage winding 54 of the instrument transformer 10. Each of the low voltage windings 77 in the current transformer 80 are mounted to an associated one of opposing ends of the second core segment. The low voltage windings 77 may be connected together in series and further connected to a terminal (not shown).

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. An instrument transformer for measuring properties of electricity flowing in an elongated conductor, said instrument transformer comprising:

a first core segment having at least one end surface;

a first encasement composed of a polymer resin, said first encasement encapsulating said first core segment except for said at least one end surface;

a second core segment having at least one end surface;

a low voltage winding disposed around said second core segment;

an electrostatic shield electrically connected to said elongated conductor, said electrostatic shield having an arcuate recess extending between a first side and a second side of said electrostatic shield along a direction of passage of said elongated connector through the instrument transformer, and wherein said elongated conductor is not in contact with said arcuate recess; and a second encasement composed of a polymer resin, said second encasement encapsulating said electrostatic shield, said low voltage winding and said second core segment except for said at least one end surface of said second core segment, said electrostatic shield embedded in said polymer resin of said second encasement and disposed slightly beneath an outer planar surface of said second encasement.

2. The instrument transformer of claim 1, wherein said at least one end surface of said first core segment adjoins said at least one end surface of said second core segment, thereby forming a current transformer having a core formed from said first and second core segments.

3. The instrument transformer of claim 2, wherein a voltage transformer is encapsulated in said second encasement, said voltage transformer for measuring the voltage of electricity flowing in said elongated conductor.

4. The instrument transformer of claim 2, wherein said electrostatic shield is generally oval in shape and has one or more cut-outs through which said second core segment extends.

5. The instrument transformer of claim 4, wherein said electrostatic shield is further comprised of a non-conductive gap disposed proximate to the center of said electrostatic shield, said non-conductive gap for preventing a conductive path around said core.

6. The instrument transformer of claim 5 wherein said electrostatic shield is formed from a semi-conductive material.

7. The instrument transformer of claim 5, wherein said electrostatic shield is formed from a conductive material.

8. The instrument transformer of claim 5, wherein said electrostatic shield is formed of a perforated sheet.

9. The instrument transformer of claim 5, wherein said electrostatic shield is formed of a solid sheet.

10. The instrument transformer of claim 1, wherein said second core segment includes a first leg and a second leg, and further wherein said electrostatic shield has a first leg opening and a second leg opening, said first and second leg openings being positioned on opposing sides of said electrostatic shield, said first leg opening sized to receive insertion of at least a portion of said first leg, said second leg opening sized to receive insertion of at least a portion of said second leg.

11. The instrument transformer of claim 10, wherein said arcuate recess extends along said electrostatic shield at a position between said first and second leg openings.

12. The instrument transformer of claim 11, wherein said first leg opening is in fluid communication with said second leg opening via an air gap, said air gap having a size that is different than a size of said first leg opening and a size of said second leg opening.

13. The instrument transformer of claim 1, wherein further including one or more inserts embedded in said second encasement, said electrostatic shield electrically connected to said one or more inserts, and wherein said one or more inserts are electrically coupled to one or more clamps that are connected to said elongated connector.

14. The instrument transformer of claim 13, wherein said one or more clamps is directly connected to said elongated connector.

15. The instrument transformer of claim 14, wherein said electrostatic shield is electrically connected to each of said one or more inserts by a wire.

16. The instrument transformer of claim 15, wherein said one or more metal inserts is each attached to one of said one or more clamps.

17. A method of making an instrument transformer, comprising:

a. providing a first core segment;
b. encapsulating said first core segment in a polymer resin to form a first encasement;
c. providing a second core segment;
d. mounting a low voltage winding to said second core segment;
e. providing an electrostatic shield between a high voltage conductor and said low voltage winding;
f. positioning said electrostatic shield above and out of contact with said low voltage winding;
g. encapsulating said second core segment, said low voltage winding, and said electrostatic shield in a polymer resin to form a second encasement;
h. aligning, after at least encapsulating said electrostatic shield, said elongated conductor along, but not in contact with, an arcuate recess in said electrostatic shield;
i. connecting said electrostatic shield to said elongated conductor.

18. The method of claim 17, wherein said step of connecting said electrostatic shield to said elongated conductor includes electrically connecting said electrostatic shield to an insert embedded in said second encasement.

19. The method of claim 18, wherein said step of connecting said electrostatic shield to said elongated conductor further includes attaching said insert to a clamp that is positioned on said elongated conductor.

* * * * *